US009649875B2

(12) United States Patent
Patel et al.

(10) Patent No.: US 9,649,875 B2
(45) Date of Patent: May 16, 2017

(54) DECORATIVE FLOWERS AND METHODS OF MAKING AND USING THE SAME

(71) Applicants: Devindra K. Patel, La Canada, CA (US); Marcia L. Victor Miller, Atlanta, GA (US)

(72) Inventors: Devindra K. Patel, La Canada, CA (US); Marcia L. Victor Miller, Atlanta, GA (US)

(73) Assignee: Devindra K. Patel, La Canada, CA (US)

( * ) Notice: Subject to any disclaimer, the term of this patent is extended or adjusted under 35 U.S.C. 154(b) by 110 days.

(21) Appl. No.: 14/099,852

(22) Filed: Dec. 6, 2013

(65) Prior Publication Data

US 2014/0161997 A1 Jun. 12, 2014

Related U.S. Application Data

(60) Provisional application No. 61/736,504, filed on Dec. 12, 2012.

(51) Int. Cl.

| | |
|---|---|
| ***B44C 1/10*** | (2006.01) |
| ***B44C 5/06*** | (2006.01) |
| *A41G 1/00* | (2006.01) |

(52) U.S. Cl.

CPC ..... *B44C 5/06* (2013.01); *A41G 1/00* (2013.01); *A41G 1/002* (2013.01); *Y10T 156/1051* (2015.01)

(58) Field of Classification Search

CPC ..... B44C 5/06; Y10T 156/1051; A41G 1/00

See application file for complete search history.

(56) References Cited

U.S. PATENT DOCUMENTS 5,314,730 A * 5/1994 Flores ..... A41G 1/00 156/61

6,159,563 A * 12/2000 Aycock Whitlock .... A41G 1/00 428/24

FOREIGN PATENT DOCUMENTS

JP 3153276 U * 9/2009

OTHER PUBLICATIONS

Origami Resource Center, "Pencil Topper (Lamb Chop Cuffs)", 2010, p. 1-2; accessed on May 20, 2015 at http://web.archive.org/web/20100704025804/http://www.origami-resource-center.com/pencil-topper.html.*

(Continued)

*Primary Examiner* — Mark Ruthkosky

*Assistant Examiner* — Julia L Rummel

(74) *Attorney, Agent, or Firm* — Andrew D. Fortney; Central California IP Group, P.C.

(57) ABSTRACT

A method for making a decorative flower is disclosed, including folding a material to form a loop, applying an adhesive within a predetermined distance from at least one of two opposing outermost edges of the material to generate a receptacle region, forming a plurality of cuts along the loop, attaching a first end of the receptacle region to a first end of a holder, wrapping a predetermined length of the receptacle region around the holder to form a base of the decorative flower, and securing the receptacle region in wrapped form to the base is disclosed. The decorative flower generally includes a folded material having a plurality of cuts along a fold thereof and an uncut receptacle region, and a holder attached to the receptacle region. The plurality of cuts form a plurality of loops, and the receptacle region forms a base of the decorative flower conveying custom messages.

20 Claims, 14 Drawing Sheets

(56) References Cited

OTHER PUBLICATIONS

Carla Jo Sinclair, "Fringed Flower Gift Topper", 2011, p. 2-10, http://makezine.com/craft/fringed_flower_gift_topper/.*
Katien Richards, "Suburban Experiment: Paper and Fauna", 2011, p. 1-8, https://suburbanexperiment.wordpress.com/tag/quilling/.*
Stephanie Lynn, "Rolled Flower Gift Toppers", 2009, p. 1-5, http://www.bystephanielynn.com/2009/12/rolled-flower-gift-toppers.html.*
English language translation for JP 3153276 U (2009), generated on Sep. 19, 2015.*
Sizzix, "The Die Cutting System", 2009, p. 1-3, Accessed on Sep. 18, 2015 at http://web.archive.org/web/20090314100348/http://www.sizzix.co.uk/die_cutting.*
Nina B, "Crafting in Croatia", 2010, p. 1-7, http://ninabdesigns.blogspot.com/2010/04/final-day-of-gkdpreviews-and-tutorial.html.*
DIY Weddings Ceremony, 2009, p. 1-4; http://diyweddingceremony.blogspot.com/2009/08/crafted-bouquet-diy-weddings.html.*
Michelle, "Delicate Construction: Felt Flower Bib Necklace", 2011, p. 1-9; Accessed on Feb. 16, 2016 at http://delicateconstruction.com/2011/04/felt-flower-bib-necklace.html.*
Bun, C.; "Tie a Printed Ribbon Round the . . . ", 2010, p. 1-13, Accessed on Feb. 16, 2016/ at http://www.weddingbee.com/2010/11/30/printing-on-ribbon/.*
Google Image Search Results for date range Jan. 1, 1990 to Dec. 11, 2011; p. 1-12; Generated on Aug. 1, 2016.*

* cited by examiner

DECORATIVE FLOWERS AND METHODS OF MAKING AND USING THE SAME

RELATED APPLICATION

This application claims the benefit of U.S. Provisional Patent Application No. 61/736,504, filed Dec. 12, 2012, which is incorporated herein by reference in its entirety.

FIELD OF THE INVENTION

The present invention generally relates to the field of communication(s). More specifically, embodiments of the present invention pertain to decorative flowers, method(s) of making decorative flowers (e.g., from standard paper, or a unique or custom patterned paper), and methods of using such decorative flowers.

BACKGROUND

Prior to the conception and development of the present invention, floral arrangements, including fresh and/or artificial flowers and/or foliage, have long been used to convey messages or activities. However, the floral arrangement typically requires a separate card to communicate specific messages. Furthermore, a separate envelope is required to keep or conceal private messages.

It is therefore desirable for decorative flowers, decorative flower arrangements, and methods for making decorative flowers to communicate customized messages without requiring an additional card and envelope.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY OF THE INVENTION

Embodiments of the present invention relate to a method for making a decorative flower including folding a material to form a fold or loop, applying an adhesive within a predetermined distance from at least one of two opposing outermost edges of the material to generate a receptacle region, forming a plurality of cuts along the fold or loop, attaching a first end of the receptacle region to a first end of a holder, wrapping a predetermined length of the receptacle region around the holder to form a base of the decorative flower, and securing the receptacle region in wrapped form to the base.

In addition, embodiments of the present invention relate to a decorative flower including a folded material having a plurality of cuts along a fold thereof and an uncut receptacle region, and a holder attached to the receptacle region. The plurality of cuts form a plurality of loops, and the receptacle region forms a base of the decorative flower.

These and other objects, advantages, and features of the present invention, together with the organization and manner of use thereof, will become apparent from the following detailed description and the claims when taken in conjunction with the accompanying drawings, wherein like elements have like numerals through the drawings described herein.

DETAILED DESCRIPTION

Figure 1:
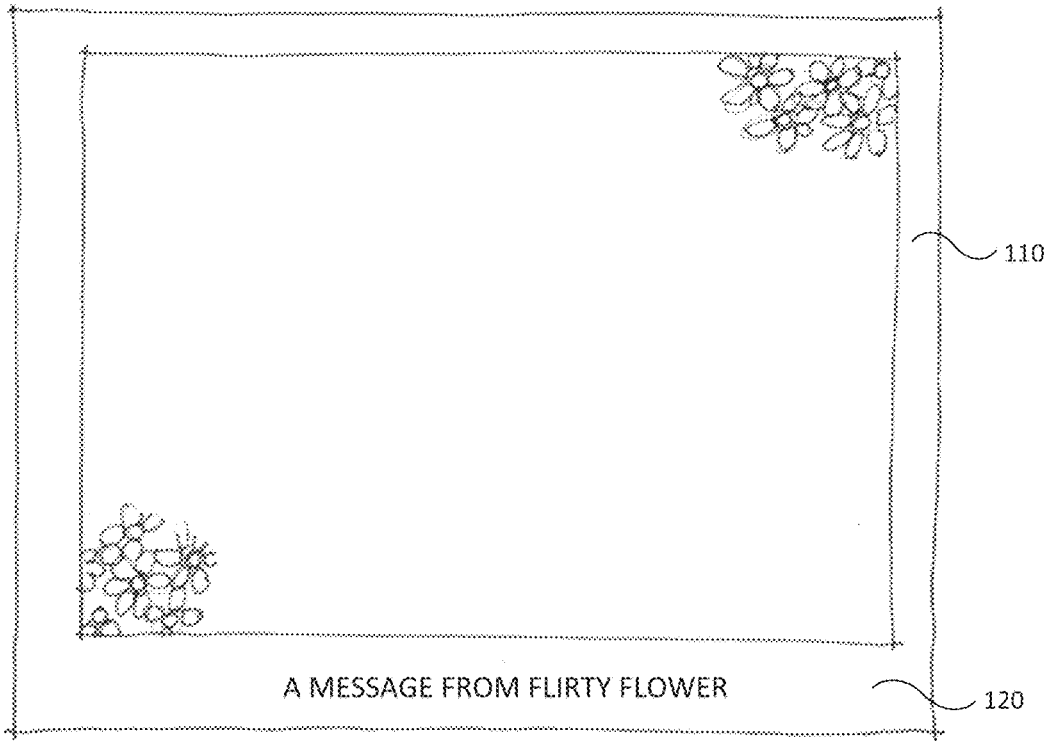
FIG. 1 is a plain view or layout of an exemplary blank or sheet of material for making a decorative flower according to embodiments of the present invention.

Reference will now be made in detail to various embodiments of the invention, examples of which are illustrated in the accompanying drawings. While the invention will be described in conjunction with the following embodiments, it will be understood that the descriptions are not intended to limit the invention to these embodiments. On the contrary, the invention is intended to cover alternatives, modifications and equivalents that may be included within the spirit and scope of the invention. Furthermore, in the following detailed description, numerous specific details are set forth in order to provide a thorough understanding of the present invention. However, it will be readily apparent to one skilled in the art that the present invention may be practiced without these specific details. In other instances, well-known methods, procedures and components have not been described in detail so as not to unnecessarily obscure aspects of the present invention. Furthermore, it should be understood that the possible permutations and combinations described herein are not meant to limit the invention. Specifically, variations that are not inconsistent may be mixed and matched as desired.

For the sake of convenience and simplicity, the terms "wrapped" and "wound" are, in general, interchangeable and may be used interchangeably herein, but are generally given their art-recognized meanings. Wherever one such term is used, it also encompasses the other terms. Similarly, for convenience and simplicity, the terms "unwrapped," "unwound," and "unraveled" may be used interchangeably herein, but are generally given their art-recognized meanings, and wherever one such term is used, it also encompasses the other terms. In addition, for convenience and simplicity, the terms "part," "portion," "area," and "region"

may be used interchangeably, but these terms are also generally given their art-recognized meanings.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

Aspects of the present invention relate to decorative flowers, and methods of making and using the decorative flowers. Embodiments of the present invention provide a unique way to convey messages or activities. Consequently, embodiments of the present invention initiate and sustain social interactions while the user is having fun, increasing positivity, and being playful. In addition, the flowers and/or bouquets may also serve as decorations and/or gifts to lighten the atmosphere or environment and possibly increase one's feelings of happiness or contentedness and/or affect one's emotional state.

Specifically, the flowers and/or flower bouquets (e.g., with or without hidden messages) may be given to individuals as gifts, and/or in some instances may be used as decorations or favors for parties, celebrations, or other events. For example, in one embodiment, each bouquet may include two or more paper flowers (e.g., 2, 3, 4, 6, one dozen, two dozen, etc.) designed for a specific party, celebration, or event. Each flower within the bouquet may contain a hidden message that can be opened by the receiving person (e.g., a guest or participant at a party, meeting, celebration or event, etc.). The hidden messages can be customized so that the message is specific to the type of party, meeting, celebration or event. As the party, meeting, celebration or event proceeds, each flower can be unraveled or unwrapped by easily pulling a leaf, tag or tab, or each flower may be opened by unlocking two or more joined or interlocking leaves to reveal the hidden message.

The invention, in its various aspects, will be explained in greater detail below with regard to exemplary embodiments.

Exemplary Methods of Making a Decorative Flower

A first aspect of the present invention relates to methods of making a decorative flower. The method for making a decorative flower includes folding a material to form a loop, applying an adhesive within a predetermined distance from at least one of two opposing outermost edges of the material to generate a receptacle region, forming a plurality of cuts along the loop, attaching a first end of the receptacle region to a first end of a holder, wrapping a predetermined length of the receptacle region around the holder to form a base of the decorative flower, and securing the receptacle region in wrapped form to the base.

Figure 2:
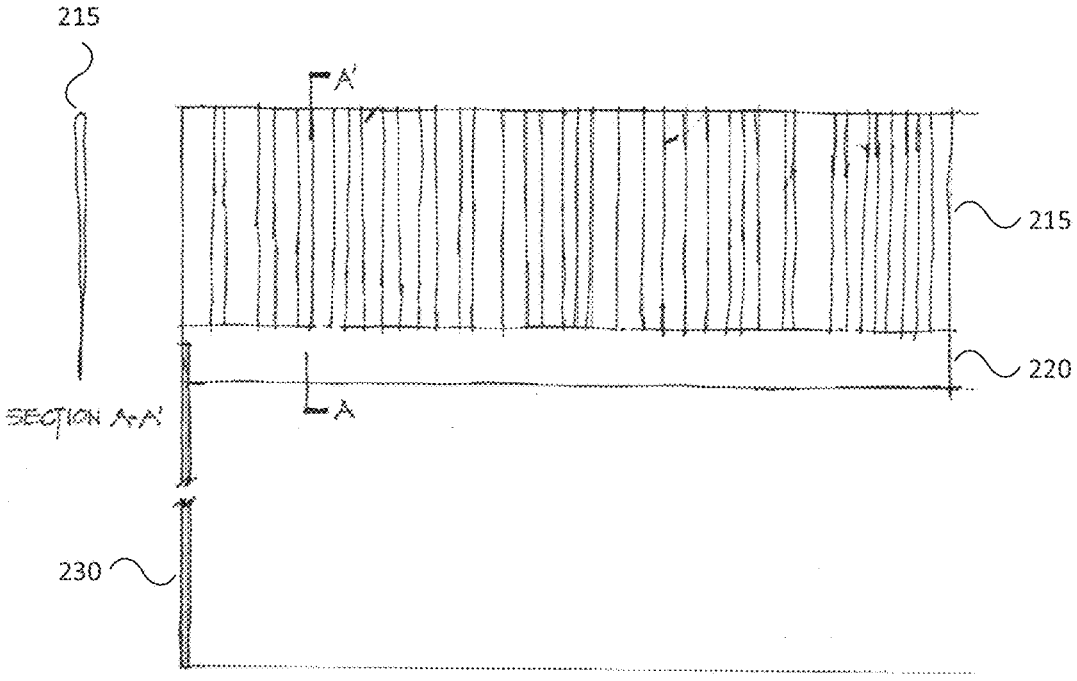
FIG. 2 is a front view of unfolded and unwrapped material for a decorative flower according to embodiments of the present invention.

In general, the materials used to create the flower are commercially available products and may be of standard size and quality (e.g., a standard 8.5"×11" sheet of paper or card stock, or the like, formed by lithography, printing press, or digital printing, etc.). Suitable materials are discussed in detail herein with regard to exemplary decorative flowers. Referring to FIGS. 1 and 2, a piece of paper or any other flat pliable material 110 is folded in half the long way (e.g., along the horizontal plane forming a double folded paper), without creasing, such that the two opposing paper edges are aligned or parallel, as shown in FIG. 2. A lower portion of the material 110 may be used to include an inscribed message area 120, as shown in FIG. 1. Alternatively, the inscribed message may be in another location, such as on one or more petals, one or more leaves, on the stem, etc.

As illustrated in FIG. 2, the two opposing outermost edges are attached to one another to generate a receptacle region 220 by using glue or other suitable adhesive or attachment mechanism. After attaching the two opposing outermost edges 220 of the paper (110 of FIG. 1), a plurality of strips or loops 215 are then made in the paper by cutting (e.g., using a die cut machine, scissors, paper cutter, razor blade, or any other suitable cutting mechanism known in the art) along the cut lines starting on the folded and looped edge opposite to the outermost edges 220. For example, a plurality of cuts 215 are made perpendicular to the horizontal folded edge (i.e., the uppermost edge in FIG. 2), and optionally, to the edge or the receptacle region 220 to be attached (i.e., the lowermost edge in FIG. 2). The plurality of cuts 215 are substantially parallel to each other and are configured to form a plurality of strips or loops. After forming the plurality of strips and/or loops, the paper (110 of FIG. 1) having the plurality of cuts is attached to a flower stem 230, as shown in FIG. 2.

The loops, strips, or petals resulting from the various cuts in the paper are illustrated along the A-A' cross section shown in FIG. 2. Specifically, as the paper or material is cut, a loop or flower petal is formed at the edge A□'. Generally, the paper or material may have a width of about 10", but not limited thereto. In general, the cuts may range in size from about ⅛" to about 2" (e.g., ⅛", ⅜", ½", 1¼", 1½", or any value or range of values therein), and resulting in a plurality of loops or strips having a length (or petal height) that corresponds to the length of the cut. In some embodiments, each petal has the same height as the other petals. However, the invention is not limited as such, and petals within a single flower may have varying or graduated heights (e.g., shorter petals toward the center of the flower and longer petals toward the outer edge of the flower, etc.).

The number of loops or petals formed in the flower generally depends on the size of the paper, the number of cuts made along the horizontal folded edge, and/or the width of the loops. However, the number of loops can be customized to suit the preferences of the consumer and/or the intended recipient(s). For example, the flower shown in FIGS. 5 and 6 has 24 loops or petals. However, the flowers may have any number of petals ranging from about 5 petals to 50 or more petals (e.g., 10-15 petals, 25-30 petals, 40-45 petals, or any other value or range of values therein). Each petal may have a width of from about ⅛" to about ¾" (e.g., ¼", ⅜", ½", ⅝", or any value or range of values therein). In some embodiments, each petal in a flower has the same width as the others. However, in other embodiments, the width may vary from petal to petal.

After the loops or petals are formed, one edge of the receptacle region 220 (e.g., one edge of the attached end of the paper) is attached to one end of a holder, dowel, stick, straw, tube or other rigid post 230. The attached end of the paper (e.g., the lowermost edge or one edge of the receptacle region 220 in FIG. 2) contacts the stick 230, but the stick or post 230 does not contact the portion of the flower blank to be cut (e.g., the uppermost edge in FIG. 2). Any suitable adhesive known in the art, such as double stick tape or glue, may be used to attach the paper to the stick. The length of the paper contacting and attached to the stick or post may range of from about ⅛" to about 1" (or any value or range of values therein), depending on the size of the flower and the length of the stick. For example, a larger flower made using a relatively large piece of material will generally have more paper contacting the stick (e.g., ¾", 1", etc.). In contrast, a smaller flower made with a relatively small piece of material will generally have less paper contacting the stick (e.g., ⅛", ¼", etc.).

Figure 3A:
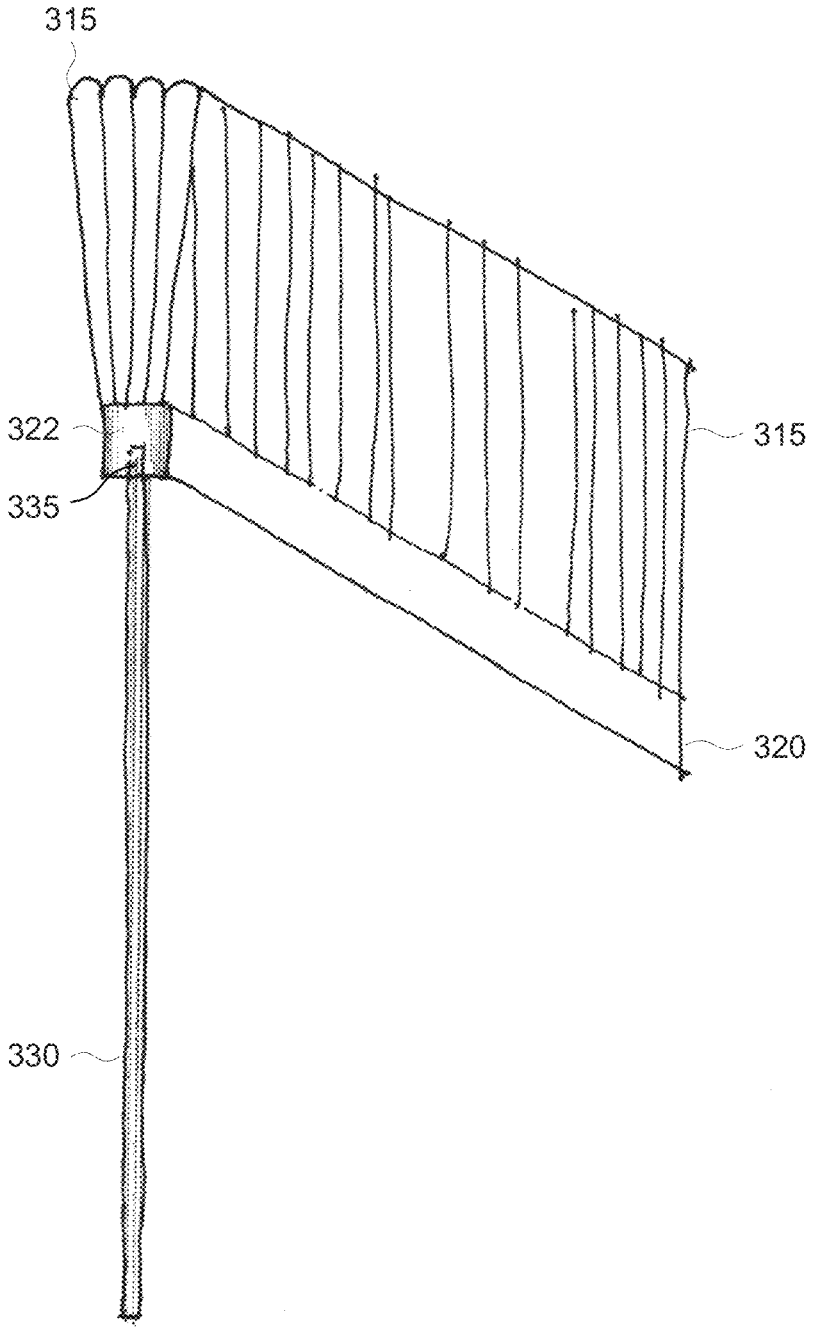
FIGS. 3A-3B are side views of a partially folded or wrapped decorative flower according to embodiments of the present invention.
Figure 4A:
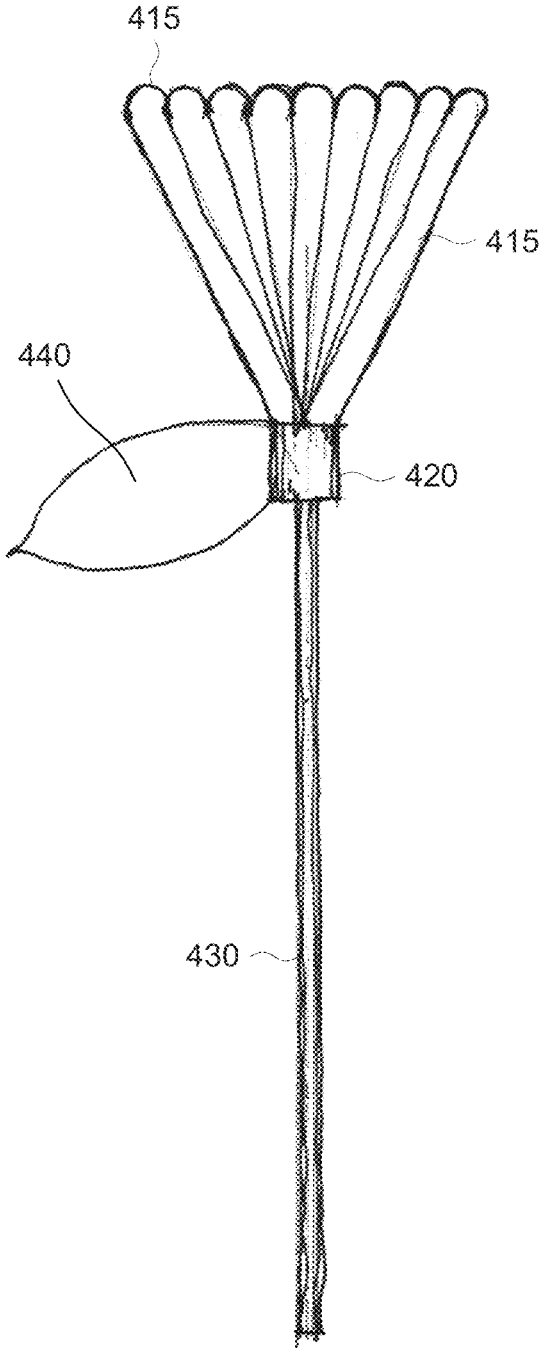
FIGS. 4A-4C are side views of various types of folded and/or wrapped decorative flower according to various embodiments of the present invention.

Referring now to FIG. 3A, after the paper flower blank 315 is attached or secured to the stick or supporting post 330, the receptacle region 320 is wrapped or wound tightly around the end of the stick 330 using any adhesive known in the art, such as Scotch® Quick Drying Tacky Glue, rubber cement, hot melt adhesive, double-sided tape, etc. The receptacle region 320 is wrapped around an uppermost portion 335 of the stick 330, generally continuously, and in one embodiment, until the paper runs out, to form a base 322 of the decorative flower. The wrapped paper (e.g., the wrapped receptacle region 330) is then sealed or secured (e.g., with semi-permanent adhesive) so that the receiver of the decorative flower can unfurl or unwrap the paper (e.g., to unwrap the receptacle region 320) to read the message at the center. For example, once the base of the paper flower is completely wrapped around the stick, a removable glue dot or other adhesive can be used to seal the flower completely to the base. Alternatively, a pair of interlocking "leaves" secured to each other can hold the base in place (see, e.g., FIGS. 4B-C). A completely wrapped and secured flower is shown in FIG. 4A. After securing the wrapped flower, the ends or loops of the paper (e.g., the paper flower blank that were cut into varying size strips) may then be pushed downward, fluffed, pulled outward, or otherwise arranged to create a blooming and "flirty" flower or blossom, as shown in FIGS. 4A-4C and 7-8, with a message thereon.

Figure 3B:
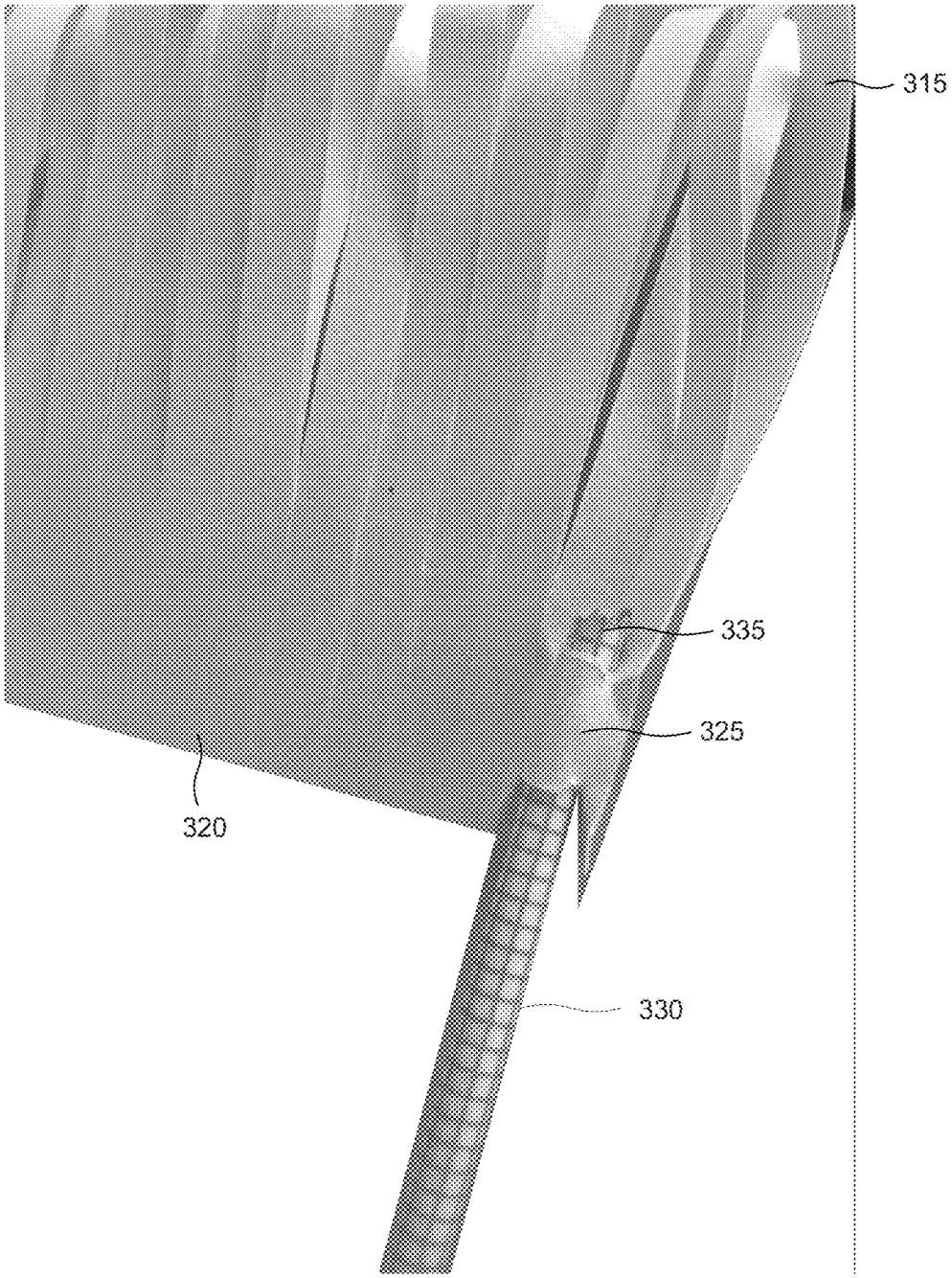

As illustrated in FIG. 3A, one edge of the receptacle region 320 is attached to one end of a holder 330. The holder 330 contacts the receptacle region 320, but does not contact the loop portion of the flower blank 315. The holder 330 may be attached to receptacle region 320 using a suitable adhesive or glue. Alternatively, as shown in FIG. 3B, the decorative flower may be attached to the holder 330 by securing the holder 330 to a pocket, pouch, or enclosure 325 in the receptacle region 320. In addition, a suitable adhesive may also be applied to the end of the holder 330 and/or the surface of the enclosure 325 facing the holder 330 to further secure the holder 330 to the pocket 325.

Figure 4B:
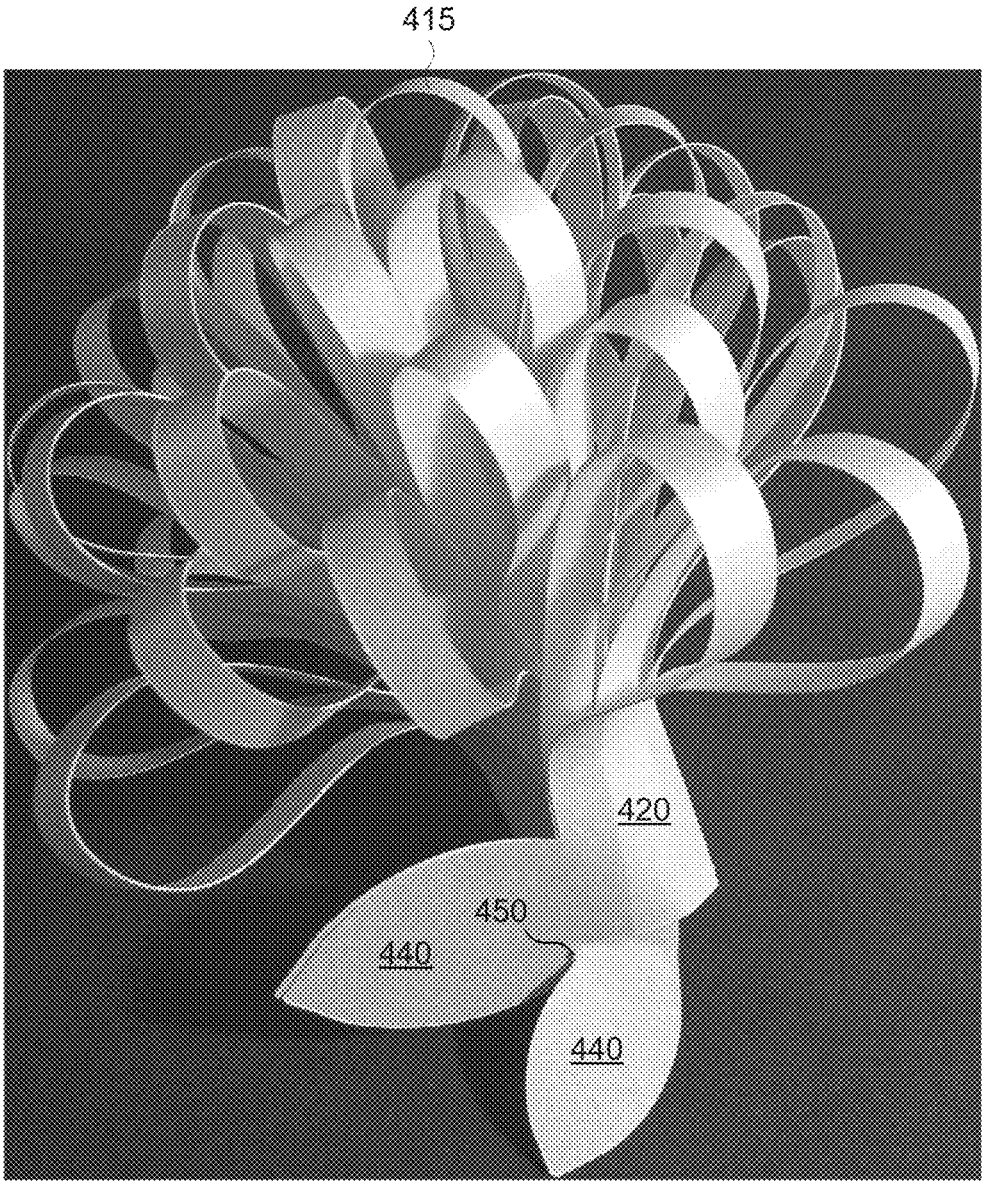
Figure 4C:
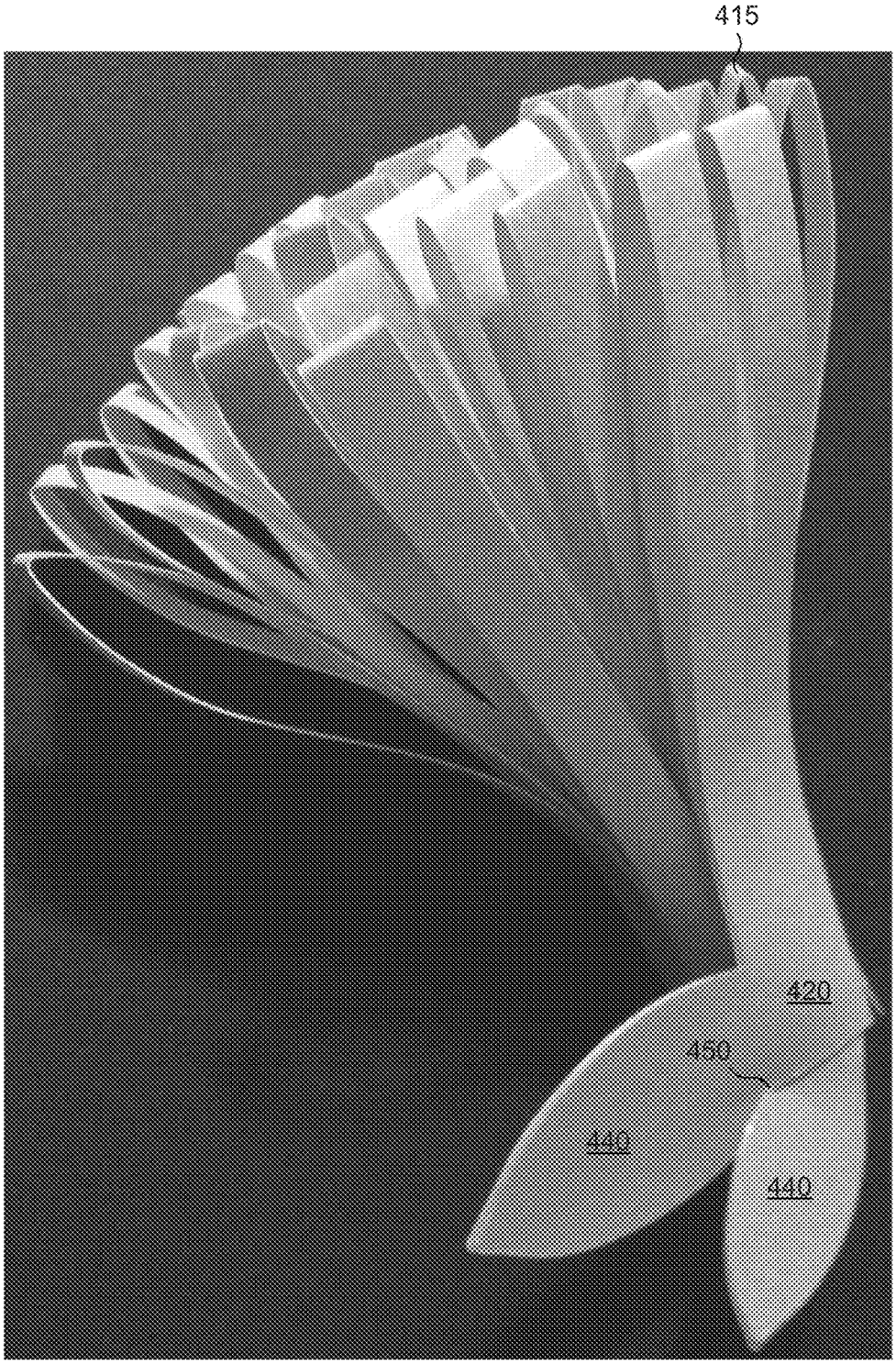

As shown in FIGS. 4A-C, a paper tag or "leaf" 440 may be cut or formed from the same material that is used to form the flower, or from a different and/or separate material. The paper tag 440 may be attached to the base of the flower. The paper tag or leaf 440 may be attached using any suitable adhesive known in the art. Alternatively, in some embodiments, the tag or leaf 440 may be integral with the receptacle region 420. In some embodiments, the adhesive that binds the leaf or tag to the flower may be stronger than the adhesive that binds the flower to the holder 430. A flower recipient, event guest, or participant can grab and/or pull the paper leaf or tag and unravel the flower to reveal a hidden message or communication (see, e.g., the leaf 940 and message 920 in the partially unraveled flower shown in FIG. 9) that was printed, inscribed or written on the paper.

Alternatively, at least two paper leaves or tags 440 may be formed in the blank with a notch or a slit therein (e.g., at or near the interface between the tag/leaf 440 and the receptacle region 420), configured to interlock the leaves/tags 440 and secure the base of the flower. As illustrated in FIGS. 4B-C, at least two interlocking paper leaves or tags 440 secure and enclose the base of the flower 420 using a notch or slit 450. The plurality of loops (e.g., in the paper flower blank) may be pushed down, fluffed, pulled outward, opened, or otherwise arranged to have an appearance of a blooming or open flower (e.g., a loopy appearance), as shown in FIG. 4B. Alternatively, as illustrated in FIG. 4C, the plurality of loops may be arranged to have an appearance of a flower bud. Other various shapes of the petals may include a slight curve, a relatively significant or noticeable curve, a straight cut, or a more ridged, rounded, squared, and/or loopy shape, similar to fresh flowers (e.g., roses, lilies, mums, etc.). Furthermore, a bouquet of various shaped or patterned decorative flowers may be presented on a piece or strip of polystyrene foam, cardboard, or the like. In addition, the bouquet of flowers (whether loose, or secured or mounted in a foam block or on cardboard, etc.) may be presented in various holders or containers, such as a paper, cardboard, glass or plastic vase, or the like.

Figure 5:
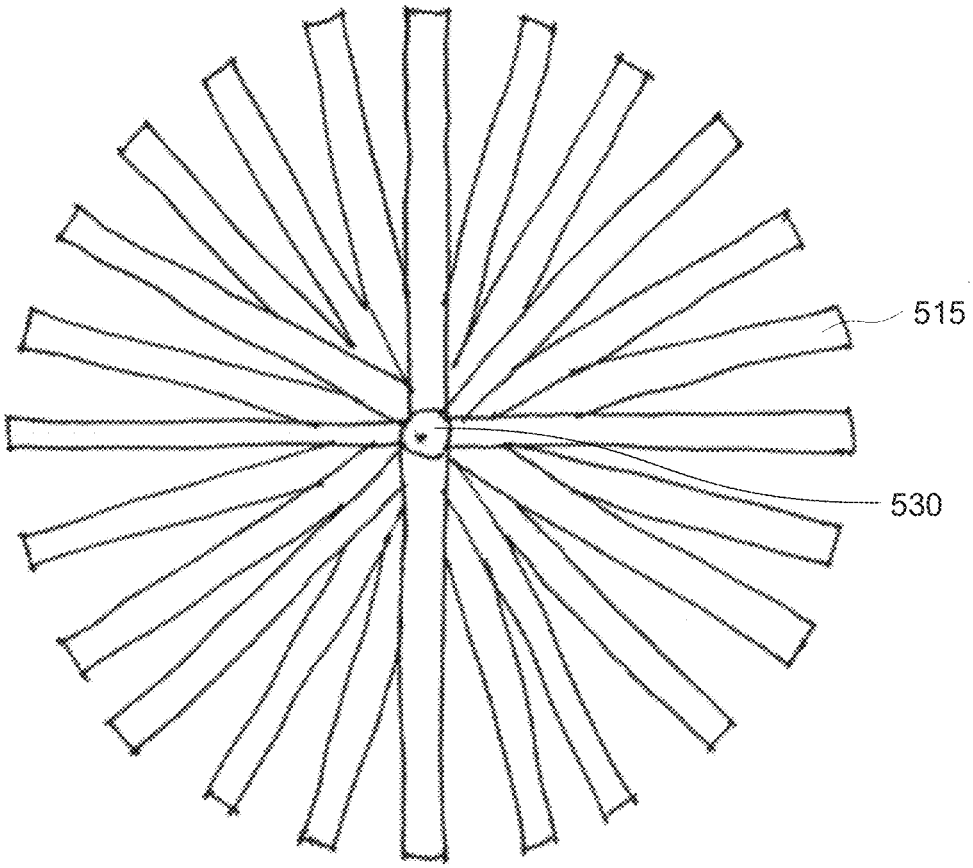
FIG. 5 is a top view of a decorative flower in an opened and wrapped position according to embodiments of the present invention.

Referring to FIG. 5, an exemplary decorative flower is illustrated in an opened position from a top view. A plurality of loops or strips 515 protrude radially from a stem 530.

Figure 6:
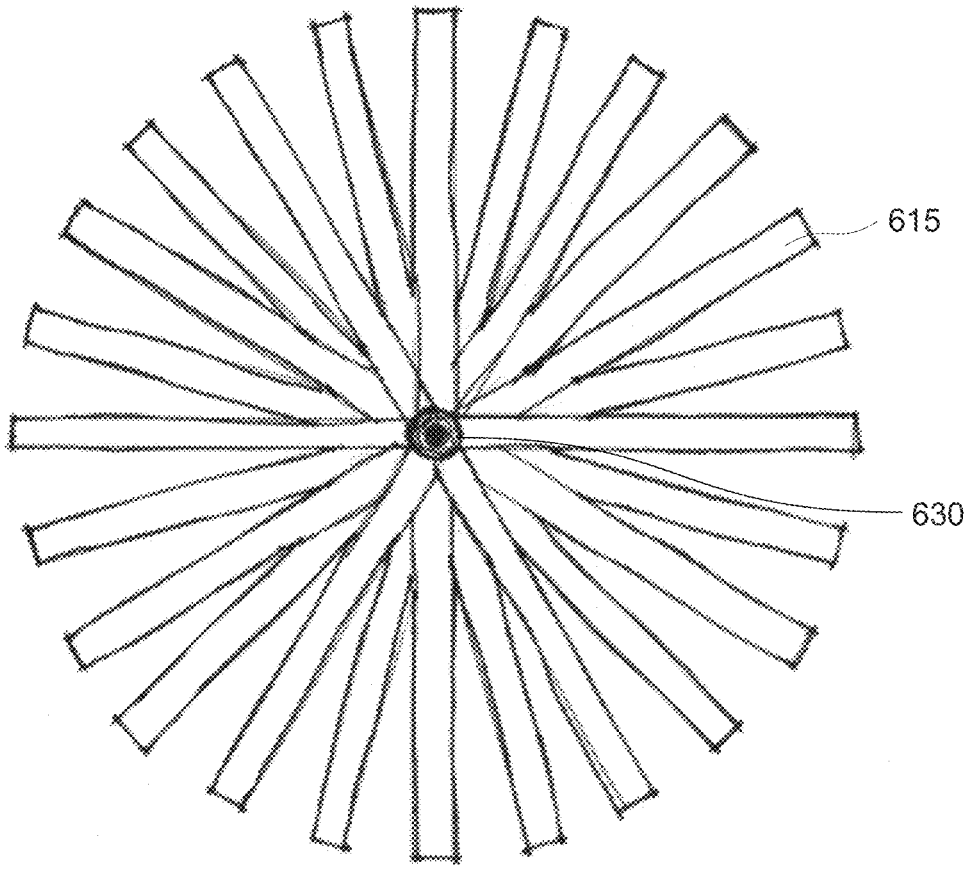
FIG. 6 is a bottom view of the decorative flower shown in FIG. 5.

FIG. 6 illustrates a bottom view of the exemplary decorative flower in an opened position attached to a holder 630. Similar to FIG. 5, the plurality of loops or strips 615 protrude radially from the stem 630.

Figure 7:
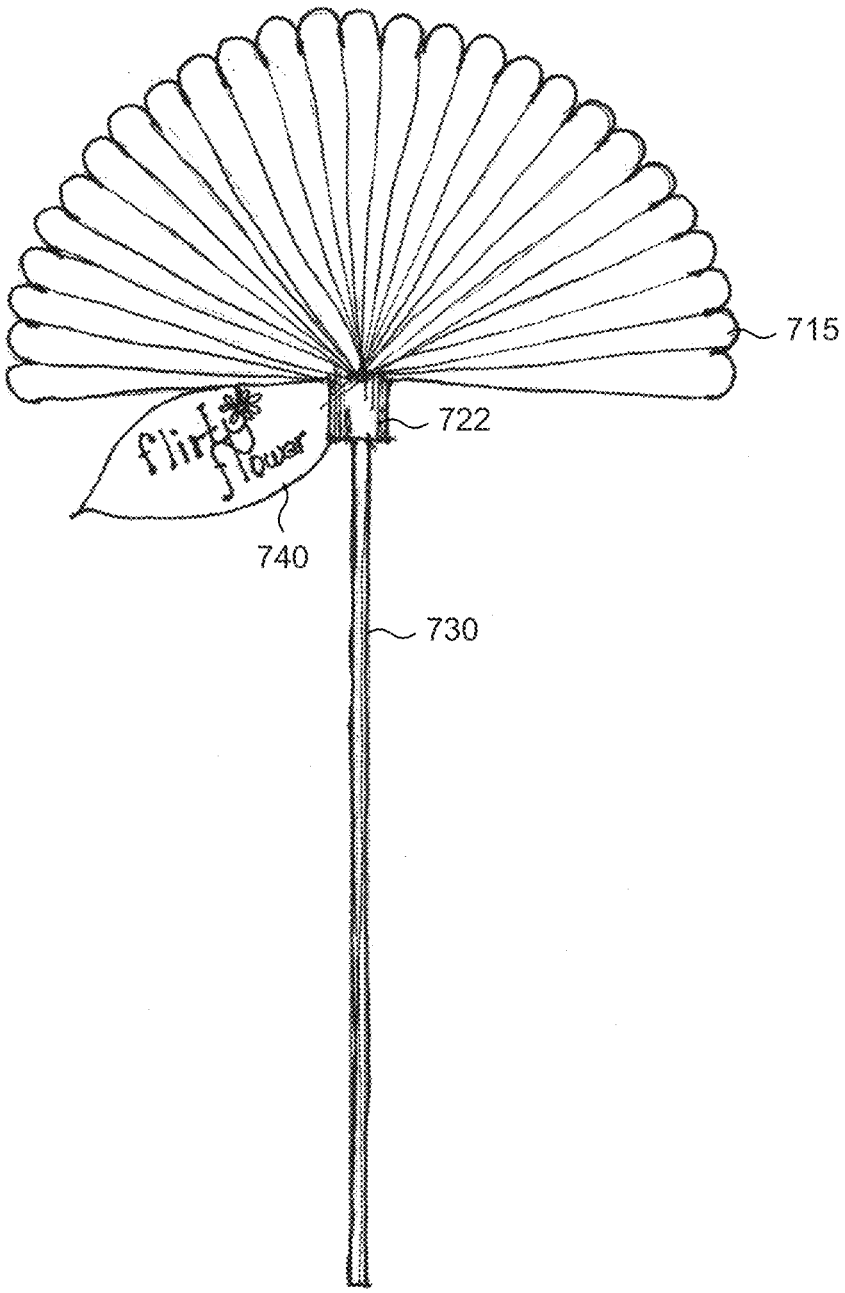
FIG. 7 is a side view of a folded and/or wrapped decorative flower according to another embodiment of the present invention.
Figure 8:
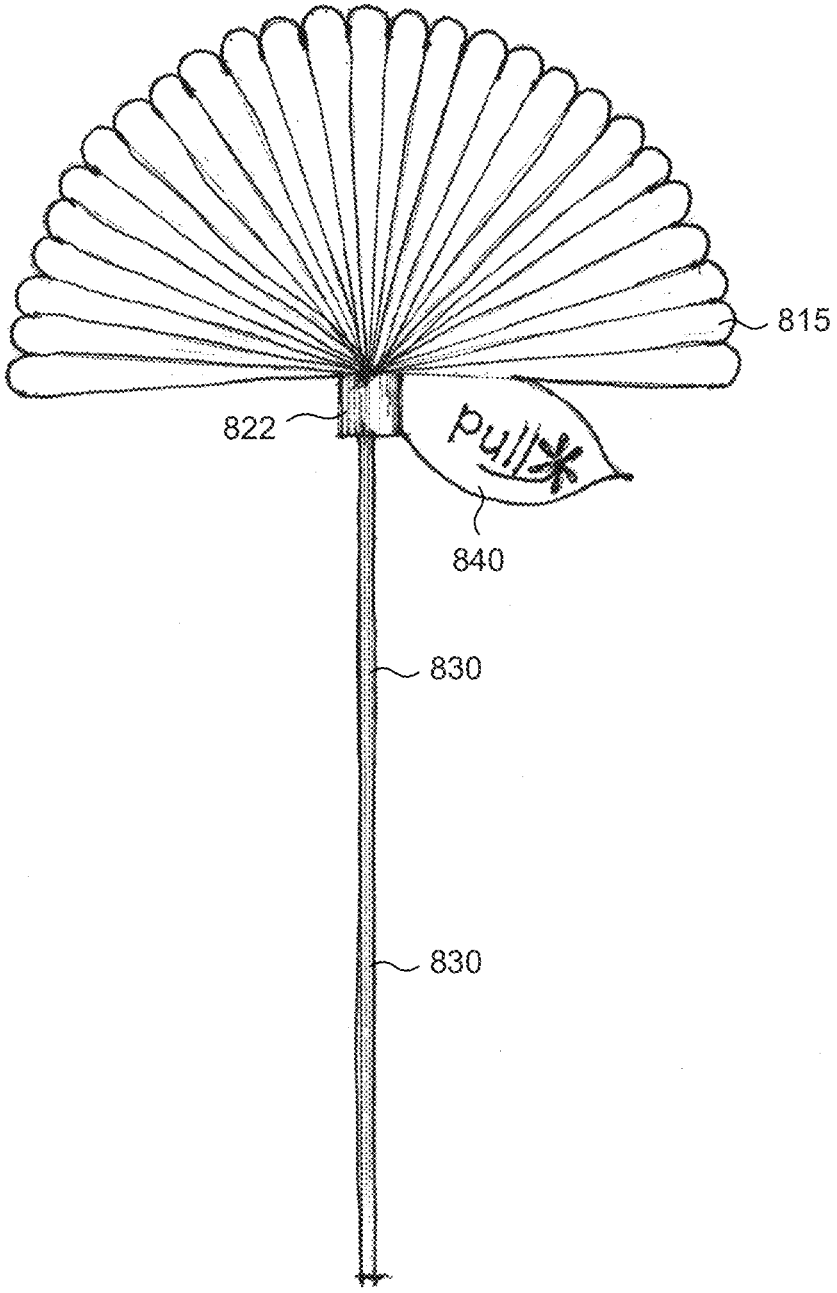
FIG. 8 is a view of the opposite side of the decorative flower in FIG. 7.
Figure 9:
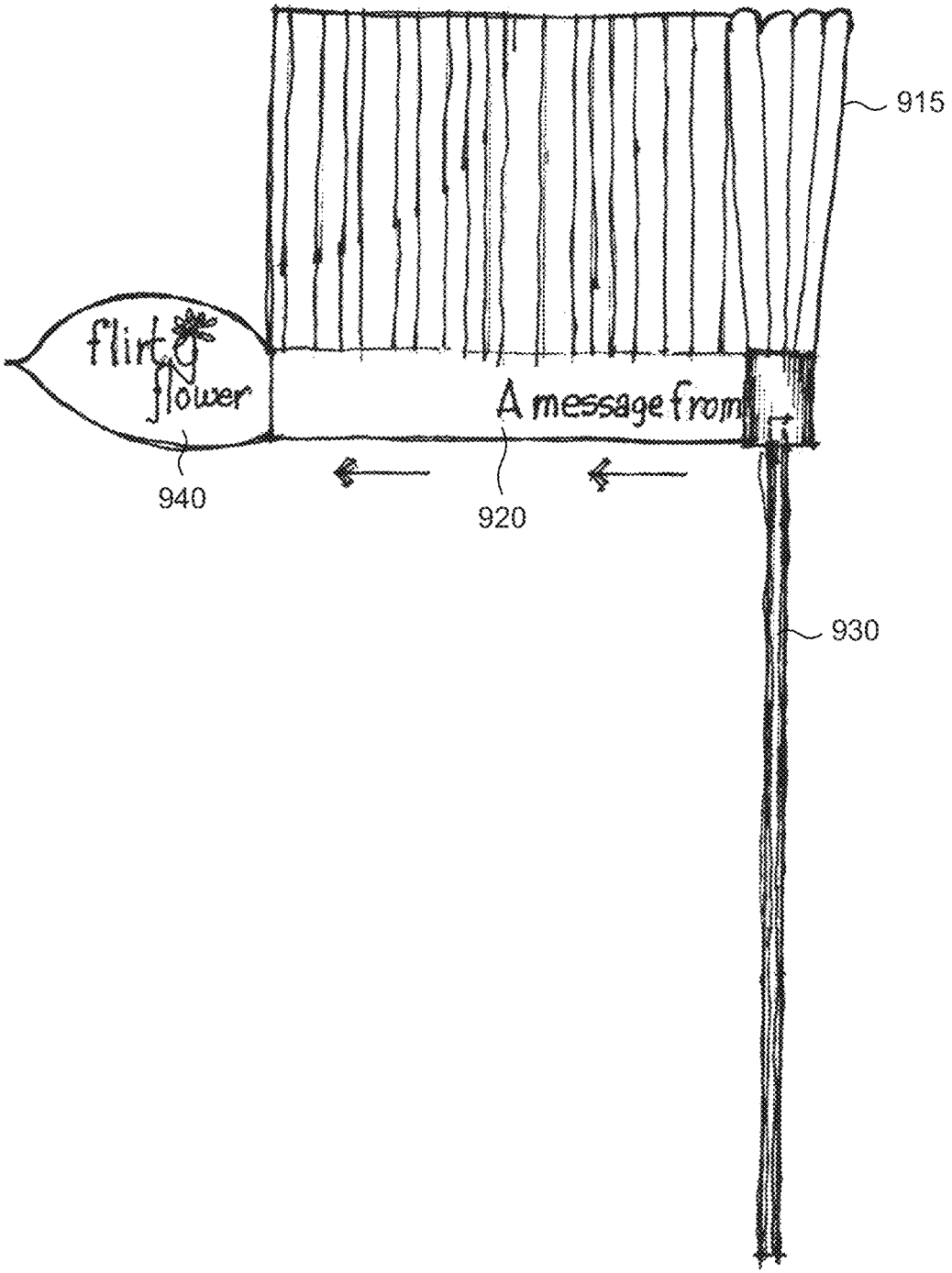
FIG. 9 is a side view of a decorative flower in a partially unraveled or unwrapped position according to embodiments of the present invention.

Referring to FIGS. 7 and 8, the paper leaf or tag 740, 840 may be attached on either side of the base 722, 822 of the flower (e.g., left or right) having a plurality of loops or petals 715, 815 extending therefrom. A flower recipient, event guest or event participant may grab, pull, and/or unlock the paper leaf or tag 740, 840 and unravel the flower (generally while holding the stem 730, 830) to reveal a hidden message or communication from left to right or right to left. Alternatively, the unraveling of the flower may occur vertically. A partially unwrapped flower that reveals a horizontally written message is shown in FIG. 9. A flower recipient, event guest, or participant can grab, pull and/or unlock the paper leaf or tag 940 and unravel the flower 915 on a stem (e.g., a rod or stick) 930 to reveal a hidden message or communication 920 (see, e.g., the partially unraveled flower shown in FIG. 9) that was printed, inscribed or written on the paper.

Figure 10A:
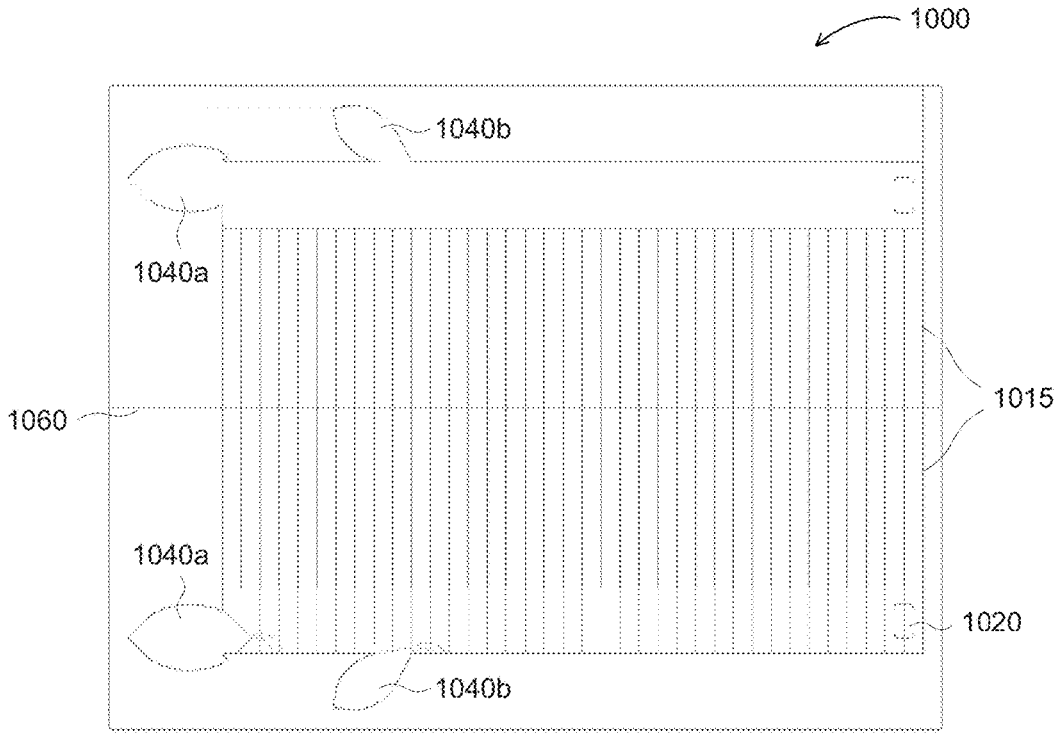
FIGS. 10A-10C are diagrams of a blank for an exemplary die cutting process for making the present decorative flower.
Figure 10B:
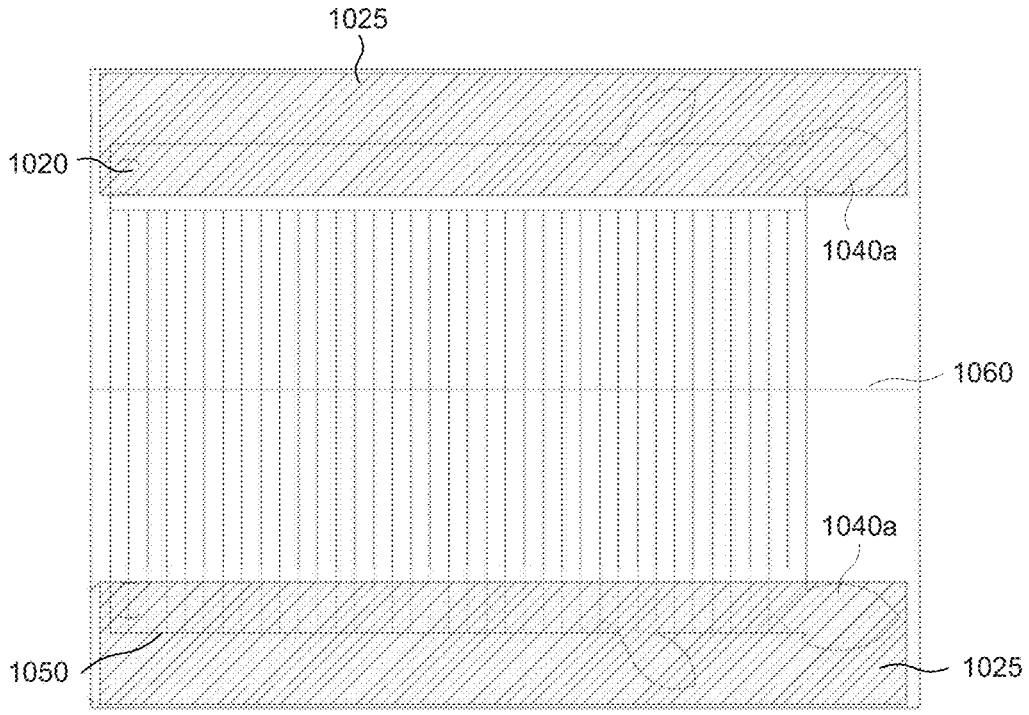
Figure 10C:
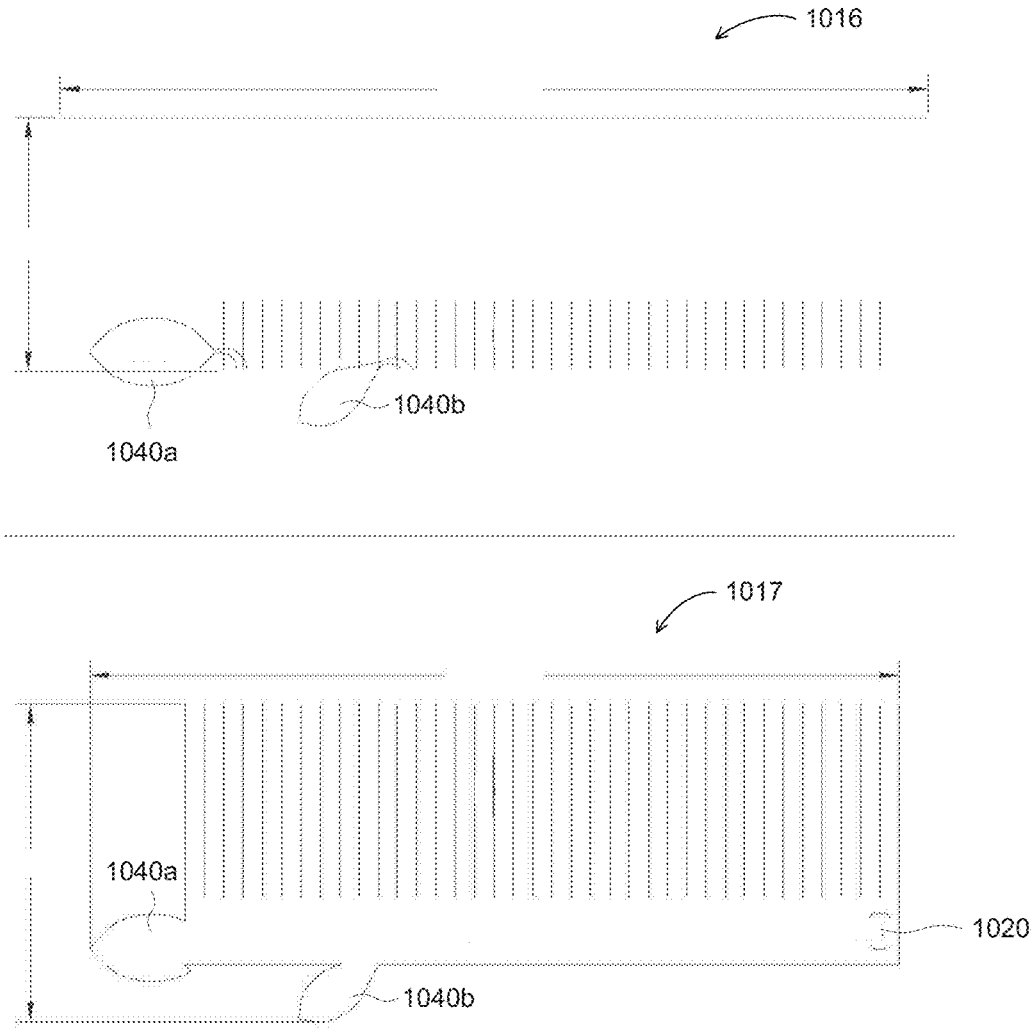

Referring to FIG. 10A, a die cut template or blank is utilized to create an outline and certain details of the flower before assembly or construction of the flower. The template or blank includes a crease and/or fold score 1060, a cut and/or score 1015, a stem pocket cutout 1020, and a leaf enclosure 1040*a-b*. For example, the template may be used by the manufacturer to create one or more die cuts or molds by shaping materials (e.g., wood, metal, plastic[s], etc.) into an outline of the flower die cut template. The die cut may be used during production to punch out the outline of the flower on the paper or material (e.g., scoring lines, creasing or folding lines, and/or the stem pocket). A first cutting die 1016, used before or after folding and/or gluing the paper/blank, is shown in the upper half of FIG. 10C. Furthermore, a second cutting die 1017, used before or after folding and/or gluing the sides of the blank 1000 of FIG. 10A to each other, is shown in the lower half of FIG. 10C.

Alternatively, scoring (e.g., cutting) the decorative flower blank along the bottom 1050 on the front and/or the back of the paper that is visible on the outside of the flower (see FIG. 10B), may occur manually or by the die cutting process after the flower is folded at the score 1060 and generally after removing an extraneous part of the region 1025 to which adhesive is applied (either before or after scoring). Scoring the flower along the bottom in even increments after folding the flower reduces tension and wrinkling in the paper before or after the paper has been adhered or glued together and folded.

Exemplary Decorative Flowers

Aspects of the present invention also relate to decorative flowers configured to communicate with one or more intended recipients. The decorative flower of the present invention includes a folded material having a plurality of cuts along a fold thereof and an uncut receptacle region, the plurality of cuts forming a plurality of loops, and the receptacle region forming a base of the decorative flower, and a hold attached to the receptacle region.

The decorative flower(s) described herein may include one or more messages, ideas, or activities that can be hidden within the decorative flower and revealed as desired. In some embodiments, a plurality of decorative flowers may be combined and arranged into a bouquet. For example, a bouquet may include two or more flowers (e.g., 3, 4, 6, 12, 18, 24, 60 flowers, etc.), each of which independently may or may not include a written message.

Exemplary decorative flowers according to embodiments of the present invention are shown in FIGS. 4A-9, and are described herein with respect to one or more of these figures. Referring first to FIGS. 4A-4C and 7-9, each decorative flower generally comprises a flower portion, which is attached to a stem portion. Each flower may independently include a message or activity hidden therein. Such a message or activity is generally printed or placed on the flower in a region or area near the base of the flower and/or where the flower is attached to the stem portion. The flower is configured to be unraveled by a recipient to reveal the hidden message or activity printed on the flower. In such embodiments, the flower may also include one or more tags, tabs, or "leaves" attached to the base of the flower, any one of which may be grabbed or pulled to open or unravel the flower portion from the supporting stick or post, and reveal the hidden message printed on the flower.

The materials used to create the flower are commercially available products. For example, the flower may comprise a sheet of paper or other flat and/or smooth, pliable material that is capable of being folded, cut, twisted and/or shaped into a desired pattern (e.g., foil, cardstock, fabric, wallpaper, plastic, paperboard, cardboard, craft paper, a relatively stiff but pliable metal material such as a metal mesh or netting, stiffened cloth, plastic- or pulp-coated fiber, etc.). The paper or other flat material may have any length and width known in the art (e.g., 8.5"×11", 4"×6", 5"×7", etc.). In some embodiments, if desired, a portion of the flat material or paper can be removed or cut off to make a smaller flower. For example, in one embodiment, 1.5" of 8.5"×11" paper can be cut off to make a smaller flower design. In one example, the paper may be 81 lb. text weight paper, but other variations may include any paper or material with a smooth or textured surface that is appropriate for use in ink jet or laser printers. Also, in some embodiments, the paper or material may have a relatively lighter weight, for example, the paper or material may comprise sheets suitable for use in printing and graphic arts (e.g., 70 lb text weight paper). The paper or material may have a pattern, be pattern-free, or have a sheen or shimmer thereon (e.g., a coating thereon providing a sheen or shimmer to the paper). In addition, the paper or material may be selected from various ranges of weights, textures, and/or colors.

In some exemplary embodiments, the flower is made of a colored paper or material, and/or comprises one or more decorative patterns, colors, or designs (e.g., flowers, polka dots, lines, sport logos, any other desired object or picture, etc.) suitable or appropriate for the intended recipient or event. The decorative pattern or design may cover some (e.g., 10%, 25%, 50%, 75%, 90%, etc.) or all (100%) of the paper or other smooth, textured, or shiny material. The paper or material color may vary (e.g., white, pink, blue, yellow, red, purple, ivory, etc.) based on the flower, bouquet and/or audience or recipient, but in general, the material comprises or consists of patterned paper and colors. For example, such decorative patterns or designs may include flowers, birds, teacups, baby rattles, polka dots, plaid or other line designs, sport logos, erotica, or any other object(s), number, or picture(s), as desired.

In some embodiments, the decorative flower may include a design, and the design may cover the entire surface of the paper or material used or may cover only a portion of the paper or material. As shown in FIG. 1, the paper or material used to make the flower may have a pattern-free portion or border on one or more sides of the pattern or design. The pattern-free border may have a thickness or width of from about ⅛" to about 2", as desired (e.g., ¼", ½", ¾", 1½", or any other value or range of values therein). In some embodiments, two or more of the pattern-free borders may have the same width. However, in other embodiments, the width of each of the pattern-free borders is different. For example, as shown in FIG. 1, in one embodiment, the left-most edge of the paper has a pattern-free border of about ¾", the right-most edge of the paper has a pattern-free border of about ½", the upper-most edge has a pattern-free border of about ½" and the lower-most edge has a pattern-free border of about 1⅛" (1.125").

Referring now to FIGS. 1 and 9, in some exemplary embodiments, a strip or border at one end of the paper or material (e.g., a receptacle region 120) for printing a message thereon. For example, the bottom edge of the paper may include a strip or border having a width of from about ½" to about 1½" (e.g., ¾", 1", 1⅛", or any value or range of values therein) that is configured to hold or display one or more messages for the intended recipient. However, the invention is not limited to the designs shown in FIGS. 1 and 10A-C. Other colors, patterns, designs and combination thereof, including a message may be used depending on the recipient, event, and/or audience. In addition, the customized message may also be inscribed on one or more petals or loops of the flower, the stem, etc.

Referring to FIGS. 4A-4C, the flower portion generally comprises a plurality of loops 415 (or looped strips) in the paper or material, each of which extends above the stem portion 430. In general, the height of each loop (or petal height) ranges from about ⅛" to about 2" (e.g., ⅜", ½", 1¼", 1½", or any value or range of values therein). In some embodiments, each petal has the same height. While in some embodiments, the flower petals may have varying heights. In some embodiments, the petals within a single flower may have graduated heights. For example, in some embodiment, the decorative flower may have shorter petals toward the center of the flower and longer petals toward the outer edge of the flower. One or more petals or loops, in addition to or instead of the receptacle region, may include one or more customized messages.

The number of loops or petals in the flower generally depends on the size of the paper, the number of cuts made along the horizontal, and/or the width of the loops. However, the number of loops can be customized to suit the preferences of the consumer and/or the intended recipient(s). For example, the flowers may have any number of petals ranging from about 5 petals to 50 or more petals in each flower, as desired (e.g., 10-15 petals, 25-30 petals, 40-45 petals, or any other value or range of values therein). Each petal may have a width of from about ⅛" to about ¾" (e.g., ¼", ⅜", ½", ⅝", or any value or range of values therein). In some embodiments, each petal in a flower has the same width. However, in various embodiments, the width may vary from petal to petal.

Referring now to FIG. 4C, in some variations, the plurality of loops 415 can be completely wrapped around the stem in a tight bundle resulting in a flower bud appearance (e.g., a flower that is beginning to open). In some embodiments, as shown in FIG. 4B, the plurality of loops 415 can be fluffed, pulled apart, or otherwise arranged to form a flower that appears to be opened or in full bloom. A top view showing one exemplary arrangement of the loops (or flower petals) in such an opened (e.g., full bloom) position is shown in FIG. 5. A bottom view of the same flower is shown in FIG. 6.

In some embodiments, the plurality of loops have been arranged to have a fan-like, layered appearance, and each loop is spaced relatively equidistant from the neighboring loops. Alternatively, the loops may be non-equidistant, resulting in the loops having various sizes, widths and/or spacings. In some examples, some or all of the cut lines in the loops may have a slight curve (e.g., representing an open flower, but requiring little effort on the manufacturer's or retailer's part). In other examples, some or all of the loops may be relatively loopy and open (e.g., substantially completely arched), with little or no sharp folding angle along the fold line. In further examples, some or all of the cut lines along the loops are straight (e.g., FIGS. 5-6), but the loops have a sharp folding angle along the fold line, and are thus relatively flat. The amount of space in the loops in such examples depends on the folding angle along the fold line. In even further embodiments, some or all of the cut lines along the loops may have a substantial curve (e.g., representing or resulting in a more open flower, but requiring slightly more care or effort to roll up when forming the base). In general, flowers having petals with substantial curves may require additional effort to roll up. The loops within an individual flower and among flowers in a group or bunch may have varying heights. Also, some or all of the loops in an individual flower, or among flowers in a group or bunch, may be cut along or below the fold line to effectively double the number of petals from such cut loops. When a loop is cut below the fold line, such cuts may be made at substantially any distance below the fold line (e.g., from $1/16^{th}$ inch to 3-4 inches, from 1-100 mm, or any distance or range of distances therein).

The stem portion of the flower may comprise a dowel, stick, or any other post that is capable of supporting the flower portion attached thereto. For example, the stem may comprise wood, ⅛" wood, plastic, cardboard, stiff paper, or any other suitable material known in the art. In some embodiments, the stick or post may be decorated, painted or dyed to look like a stem, and/or to match or complement the pattern or design of the flower portion attached thereto. For example, in some embodiments, the stem or post comprises a painted wooden or a dyed colored plastic stick or skewer. In various embodiments, the stem may comprise a straw or hollow tube that can be filled, for example, with a (consumable) substance, such as sugar (which may or may not further include one or more colorings and/or flavorings).

As shown in FIG. 4A, the stick or support post 430 has a cylindrical shape. However, the stick or post may have various shapes, including but not limited to square, oval, triangle, irregular or spiral. In some exemplary embodiments, the stick or post may have a length of from about 2" to about 12", or any desired length suitable for supporting the paper flower attached thereto. In some embodiment, the length of the stick or post may be determined by the size of the flower attached thereto, the number of flowers arranged in the bouquet and/or the desired arrangement of the flowers (e.g., long-stem vs. short-stem varieties, a mixture of relatively short and relatively long stems, etc.). Similarly, the diameter of the stick may range from about 1/16" to ¼" (or any value or range of values therein), and may be selected such that the diameter is sufficient to support the paper flower attached thereto.

The flowers and sticks may vary in size and color depending on intended audience and/or use. For example, in some embodiments, the size of the flower portion may have relatively small blooms with a diameter of from about 1" to 2", or any value or range of values therein. In other embodiments, the size of the flower portion may have relatively large blooms, for example with a diameter of from about 2" to 5", or any value or range of values therein. In general, the height of the flower is proportional to the diameter, and may range of from about ½" to 5", as measured from the base of the flower portion (attached to the stem) to the top of the loops.

The sticks or support posts (the stems) are generally cylindrical in shape. However, the stick may have any suitable shape known in the art (e.g., triangular, rectangular, spiral, etc.). Each stick or stem may have a length of from about 2" to about 12", or any desired length suitable for support the paper flower attached thereto (e.g., 3" to 10", 4" to 8", 5" to 7", 6", or any other value or range of values therein). The length of the stem may be determined largely by the number of flowers in a particular bouquet and/or by the desired arrangement of the flowers for the intended recipient (e.g., long-stem vs. short-stem flowers, mixtures of relatively short and long stems, etc.). In some exemplary embodiments, the length of the stem is proportional to the diameter of the flower attached thereto. For example, a flower with a relatively small diameter may be attached to a stick or stem that is relatively short, and similarly, a flower with a relatively large diameter may be attached to a stick or stem that is relatively long. Furthermore, the stem may have a thickness of ⅛", but is not limited thereto. In the present invention, the sizes of the flowers and stems can be mixed and matched as desired.

In various exemplary embodiments, the flower portion is attached or secured to the stick or supporting post using any adhesive known in the art (e.g., double stick tape, glue, hot melt adhesive, rubber cement, etc.). In addition, the completely wrapped flower is secured to itself using a semi-permanent adhesive (e.g., removable glue, etc.) that allows a recipient to unravel the flower (e.g., using a more permanently attached or adhered leaf, tag, or tab as described herein) to reveal the hidden message or activity.

Exemplary Methods of Using a Decorative Flower

Further aspects of the present invention relate to methods of using the decorative flower(s) described herein. In some embodiments, the flowers described herein are used primarily for decorative purposes. For example, in such implementations, one or more flowers (e.g., a single flower or a bouquet including 2, 3, 6, 12, 18, 24, 60 or more flowers) can adorn any suitable space or event, or the flower(s) can be presented to a recipient as a gift, a prize, or for recognition (e.g., birthday, anniversary, bridal, door prizes, employee of the month, etc.).

In some embodiments, one or more flowers within a bouquet may contain a hidden message or communication that can be opened by a customer or recipient. The hidden messages can be customized or specific to the type of celebration or event. As the celebration or event gets underway, each flower is unraveled by easily pulling a leaf or tag and the message is revealed. Consequently, the decorative flowers may be used for any function or purpose suitable for conveying messages, questions, or activities, or for playing games, etc.

For example, in some embodiments, the flowers with hidden messages may be used for socialization and life celebrations (e.g., bridal showers, baby showers, birthdays, weddings, anniversaries, graduations, parties, sporting events, Greek life, etc.). In some instances, the messages hidden in the flowers or bouquet of flowers can enable games and/or other activities by conveying information, providing instructions, and/or asking questions (e.g., scavenger hunts, trivia games, horoscopes or fortune telling, truth or dare, table number identifier and/or seating arrangement indicator for events such as weddings, anniversary parties, banquets, etc.).

In other instances, the flowers can be used in various professional settings as an icebreaker or other training tool. For example, in such variations, the messages in the flowers may convey information, provide instructions or introduce activities in workshops, team building situations or activities, brainstorming, etc. In other instances, the flowers may be used for professional or corporate celebrations (e.g., to say thank you, farewell, congratulations, etc.).

In some variations, the flowers can be used to convey messages or provide activities that enhance or improve personal relationships, for example to say thank you, thinking of you, get well, congratulations, or I love you; to convey marriage proposals, to apologize, or to introduce games or conversation starters (e.g., for couples, erotica, etc.). In other variations, the flowers and messages may be used for therapeutic purposes (e.g., to provide encouragement, to communicate or list various therapeutic activities including but not limited to physical, occupational, emotional and/or psychological therapy activities and/or exercises, etc.). In other variations, the flower may be used for religious functions (e.g., holidays, bar and bat mitzvahs, bible study, etc.). In further variations, the flower or flowers/bouquet may have a fragrance added to them, for example so that the flower(s) have a flower-like smell. In an even further variation, a recorded message and/or music may accompany the flower(s). For example, pulling the leaf or tag may activate a circuit that plays a recorded message or song, etc.

CONCLUSION

Thus, the present invention provides a decorative flower and methods of making and using decorative flowers. Embodiments of the present invention provide a customizable and unique way to communicate messages and/or promote activities. In addition, the decorative flowers and/or decorative bouquets may serve as decorative and/or special gifts to initiate and sustain positive social interactions. More specifically, the decorative flower may be customized to contain commercial, private, confidential, and/or hidden messages, without requiring additional cards and/or envelopes.

The foregoing descriptions of embodiments of the present disclosure have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A method for making a decorative flower having a hidden, revealable message, communication or activity therein for a recipient of said decorative flower, comprising:

printing or inscribing said message, communication or activity on only a receptacle region along a first edge of a sheet of material having two opposing outermost edges including a first edge;

folding said sheet of material to form a loop;

applying an adhesive within a predetermined distance from at least one of said two opposing outermost edges of said sheet of material and attaching said two opposing outermost edges to one another, said receptacle region with said message, communication or activity being located on an outer surface of said loop;

forming a plurality of cuts along said loop;

attaching a first end of said receptacle region to a first end of a holder selected from the group consisting of a dowel, a stick, and a rigid tube, wherein a sufficient length of the holder projects away from the receptacle region such that the holder can be grasped along its length by a user;

wrapping said receptacle region around said holder to form a base of said decorative flower and hide said message, communication or activity after said base of said decorative flower is formed;

providing a tag, said tag optionally being integral with said sheet of material;

securing said tag to said base and/or receptacle region, wherein when said tag is pulled away from said base by said recipient, said receptacle region is unwrapped and said message, communication or activity is revealed; and securing said receptacle region in wrapped form to said base.

2. The method of claim 1, further comprising aligning said two opposed outermost edges of said sheet of material when folding said sheet of material to form said loop, and said tag is integral with said base and/or receptacle region.

3. The method of claim 1, wherein forming said plurality of cuts comprises die cutting.

4. The method of claim 3, wherein said plurality of cuts are substantially parallel to each other, and are configured to form a plurality of strips or loops.

5. The method of claim 4, wherein said plurality of cuts are substantially perpendicular to a fold line of said loop and/or an edge or border of said receptacle region.

6. The method of claim 5, wherein each of said plurality of cuts has a predetermined length, and each of said plurality of strips or loops have a predetermined width.

7. The method of claim 1, wherein said sheet of material comprises paper, tissue, plastic, cardboard, craftpaper, construction paper, a mesh, or cloth.

8. The method of claim 7, wherein said sheet of material has a pattern thereon.

9. A decorative flower having a hidden, revealable message, communication or activity therein for a recipient of said decorative flower, comprising:

a sheet of folded material that, prior to being folded, has two opposing outermost edges, said sheet of folded material having a plurality of cuts along its fold and an uncut receptacle region on an outer surface thereof and along an outermost edge or border opposite the fold, the plurality of cuts forming a plurality of loops, said receptacle region forming a base of said decorative flower, and said message, communication or activity printed or inscribed only on a surface of said receptacle region;

a holder attached to said receptacle region, wherein said holder is a dowel, stick, or rigid tube, said receptacle region is wrapped around said holder, and said message, communication or activity is hidden when said receptacle region is wrapped around said holder and a sufficient length of said holder extends from the receptacle region such that the holder can be grasped along its length by a user; and a tag integral with and/or secured to the base and/or receptacle region, wherein when said tag is pulled away from said base by said recipient, said receptacle region is unwrapped and said message, communication or activity is revealed.

10. The decorative flower of claim 9, wherein said sheet of folded material has aligned outermost edges that form said edge or border of said sheet of folded material, and said tag is integral with said base and/or receptacle region.

11. The decorative flower of claim 9, wherein said plurality of loops are substantially parallel to each other.

12. The decorative flower of claim 11, wherein each of said plurality of loops have a long axis substantially perpendicular to a fold line of said folded material and said edge or border of said receptacle region.

13. The decorative flower of claim 12, wherein each of said plurality of loops has a predetermined width and length.

14. The decorative flower of claim 10, wherein said sheet of folded material comprises paper, tissue, a plastic, cardboard, craftpaper, construction paper, a mesh, or a cloth.

15. The decorative flower of claim 14, wherein said sheet of folded material has a pattern thereon.

16. The decorative flower of claim 9, further comprising an adhesive adhering opposed sides of said sheet of folded material.

17. The method of claim 1, wherein securing said tag to said base comprises attaching said tag to an interlocking tag.

18. The method of claim 1, wherein said holder is said dowel or said stick.

19. The decorative flower of claim 9, wherein said decorative flower further comprises an interlocking tag to which said tag can be secured or attached.

20. The decorative flower of claim 9, wherein said holder is said dowel or said stick.

* * * * *